United States Patent [19]

Collis

[11] 4,227,632

[45] Oct. 14, 1980

[54] FLEXIBLE GARMENT HANGER

[76] Inventor: John H. Collis, P.O. Box 26093, Houston, Tex. 77027

[21] Appl. No.: 913,623

[22] Filed: Jun. 8, 1978

[51] Int. Cl.³ ..... A47J 51/10

[52] U.S. Cl. ..... 223/94

[58] Field of Search ..... 223/94, 89

[56] References Cited

U.S. PATENT DOCUMENTS

| | | | |
|---|---|---|---|
| 1,286,022 | 11/1918 | Klesat | 223/94 |
| 1,886,869 | 11/1932 | Button | 223/94 |
| 2,290,722 | 7/1942 | Weingarten | 223/94 |
| 2,509,754 | 5/1950 | Badalamenti | 223/94 |
| 2,716,513 | 8/1955 | Braunstein | 223/94 |
| 2,728,499 | 12/1955 | Mueller | 223/94 |
| 2,774,526 | 12/1956 | Reuer | 223/89 |
| 3,401,855 | 9/1968 | Balzer et al. | 223/94 |
| 3,531,028 | 9/1970 | Vazquez | 223/94 |
| 4,114,786 | 9/1978 | Wiese | 223/94 |

*Primary Examiner*—George H. Krizmanich

*Attorney, Agent, or Firm*—Fulbright & Jaworski

[57] ABSTRACT

A flexible garment hanger preferably formed of a one-piece, molded plastic-like material having a body, two hanger arms connected to the body by integral flexible hinge portions and a locking bar below the body of the hanger secured to both arms by means of similar integral flexible hinge portions with a stop member projecting medially from the locking bar and having two additional integral flexible hinge portions, one on either side of the stop member. By pulling down on the stop member, the locking bar is deflected downwardly past an overcenter position which in turn allows the two hanger arms to be compressed downwardly and inwardly into a collapsed position. The hanger is locked into a fully deployed position by forcing the stop member upwardly towards the body so that the locking bar passes beyond its center position into an overcentered locking position. The weight on the hanger arms while the locking bar is in an overcentered position and the stop member is abutting the body maintains the locking bar in an overcentered and locked position. A second embodiment carries a hook which is slidably received through an aperture in the body and connected to the stop member. Another embodiment carries a single integral flexible hinge portion connecting the two hanger arms. A hook is slidably received through an aperture in the single hinge around which the two hanger arms are deflected into a collapsed position. A final embodiment replaces the overcenter locking means with a two-segment trouser bar connected at each end to an arm by an integral flexible hinge portion and removably secured at the median by a rigid member.

13 Claims, 8 Drawing Figures

FLEXIBLE GARMENT HANGER

BACKGROUND OF THE INVENTION

Garments such as "T" shirts, pull-over sweaters, and the like are commonly retained on garment hangers. Although the garment hanger retains to garment acceptable, it is frequently difficult to remove the garment from the hanger by pulling the hanger through the neck. On the contrary, a more tedious removal requires the extraction of the hanger arms from the garment arms and a removal of the hanger through the bottom of the garment. Infants' and children's clothing are similarly difficult to remove from conventional hangers. Moreover, discount markets and clothing stores frequently desire to retain the hanger upon which a garment is sold, requiring the hanger to be removed from the garment or garments at the cashier's booth. Unnecessary expenditure of time and frustration often occurs in having to remove several garments from several hangers.

Because of the large inventory of hangers retained by many stores, it is both desirable and necessary to utilize a hanger which is inexpensive and yet capable of quick and simple removal from a garment without stretching or damaging it.

STATEMENT OF THE PRIOR ART

Applicant is aware of, cites to the Examiner and includes copies of with this application the following prior art:

| | |
|---|---|
| 949,815 Anderson | February 22, 1910 |
| 958,366 Clausen | May 17, 1910 |
| 1,696,480 Hawkins | December 25, 1928 |
| 1,697,719 Daigle | January 1, 1929 |
| 2,810,500 Wingate | October 22, 1957 |
| 3,698,607 Batts | October 17, 1972 |

The patents noted below relate to structures of plastic hinges:

| | |
|---|---|
| 3,767,092 Garrison | October 23, 1973 |
| Canadian - 835,010 | February 24, 1970 |
| British-1,033,233 | June 22, 1966 |
| British -1,232,580 | May 19, 1971 |

and a hanger manufactured by Kingly Products Corporation entitled Foldaway Hanger No. 204.

The Foldaway Hanger has deflectable arms, but the arms classically deflect upward instead of downward thereby not entirely resolving the challenge of removing the hanger through the neck of a "T" shirt or a turtleneck shirt. The Anderson device discloses two rigid arm members which pivot about a hook member and which are held rigid by extending the trouser bar into a straight line. The Clausen device shows an adjustable and collapsable hanger having two wire hanger arms extendable by forcing down the element 12 and which are contained by the trouser rod at either end thereof.

The Hawkins device discloses a collapsable hanger having a plate and disposable ears. The terminable plates rotate underneath other plates which in turn pivot around a point. The Daigle device discloses a collapsable hanger whose arms pivot and collapse about a point.

The Batts device discloses a non-deflectable hanger having flexible hinge clamps for gripping a garment.

The Garrison patent and the three foreign patents disclose a deformable thermoplastic hinge and various other embodiments of similar hinges.

None of these devices include all the elements of the present invention. Nothing in the prior art discloses and claims a hanger whose arms deflect downwardly for upward extraction from within the garment, utilizing solely integral flexible plastic-like hinges which are a part of the hanger apparatus, an overcenter locking device and a hanger which further collapses in a vertical plane.

SUMMARY OF THE PRESENT INVENTION

The present invention is directed to an economically manufactured collapsable garment hanger which can be removed upwardly through the neck or similar orifice of garments hanging thereon. The present invention is further directed to a garment hanger which can be locked into a deployed position suitable for hanging garments thereon and easily unlocked to permit downward and inward deflection of the hanger arms and subsequent upward extraction of the hanger from the garment. An additional embodiment substitutes a two-segment trouser bar integrally and hingedly connected at each end to an arm of the hanger, and each segment removably securable to each other by means of a locking device.

Accordingly, it is an object of the present invention to provide a garment hanger having a pair of hanger arms which are easily deflectable downwardly and inwardly in a vertical plane.

It is a further object of the present invention to provide a garment hanger which is deployed and collapsed with a minimum of effort and manual operation.

Still a further object of the present invention is to provide a garment hanger which is easily locked into a deployed position.

Yet another object of the present invention is to provide a garment hanger having downwardly deflectable hanger arms which can be maintained in a deployed position by means of a segmented trouser bar connected to each hanger arm by an integral flexible hanger portion thereof and the segments thereof removably secured to each other by a simple conventional means.

An even further object of the present invention is to provide a flexible garment hanger which is easily deployed and locked as well as unlocked and collapsed and which is economically manufactured by either one piece molding or by one piece molding with a separate hook member inserted therethrough.

Further objects and other features and advantages of the present invention will be apparent in the following description of the preferred embodiments of the invention, given for the purpose of disclosure and taken in conjunction with the accompanying drawings and claims.

BRIEF DESCRIPTION OF THE PREFERRED EMBODIMENTS

Figure 1:
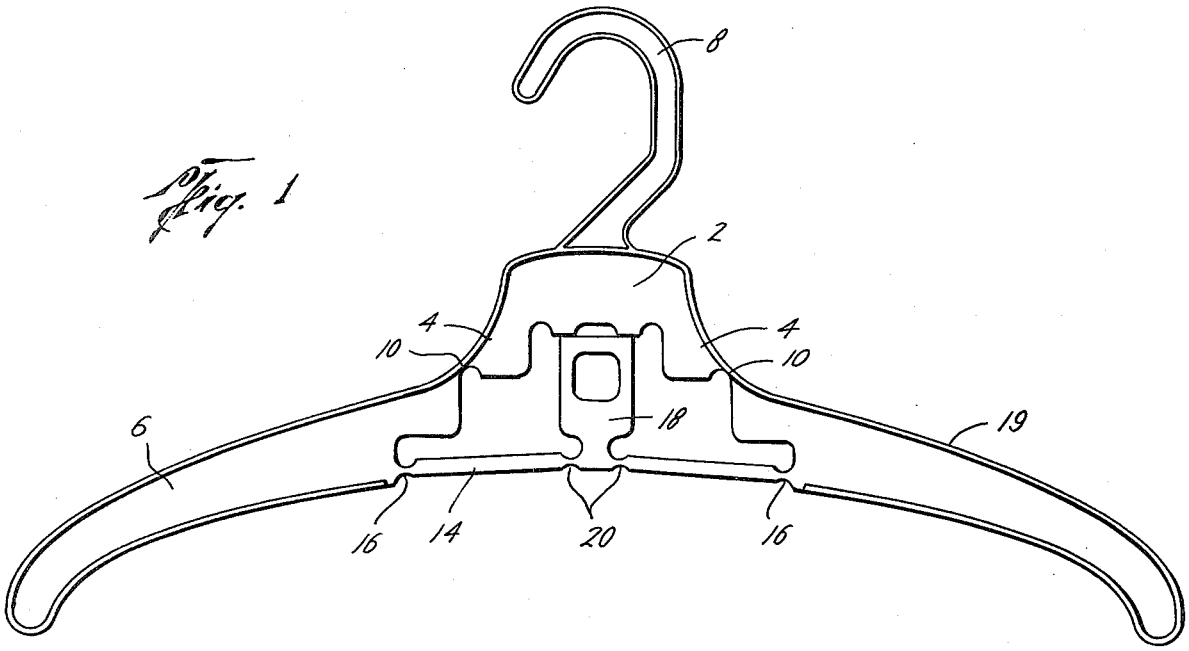
FIG. 1 is a side view of the invention showing the hanger in the deployed position.
Figure 2:
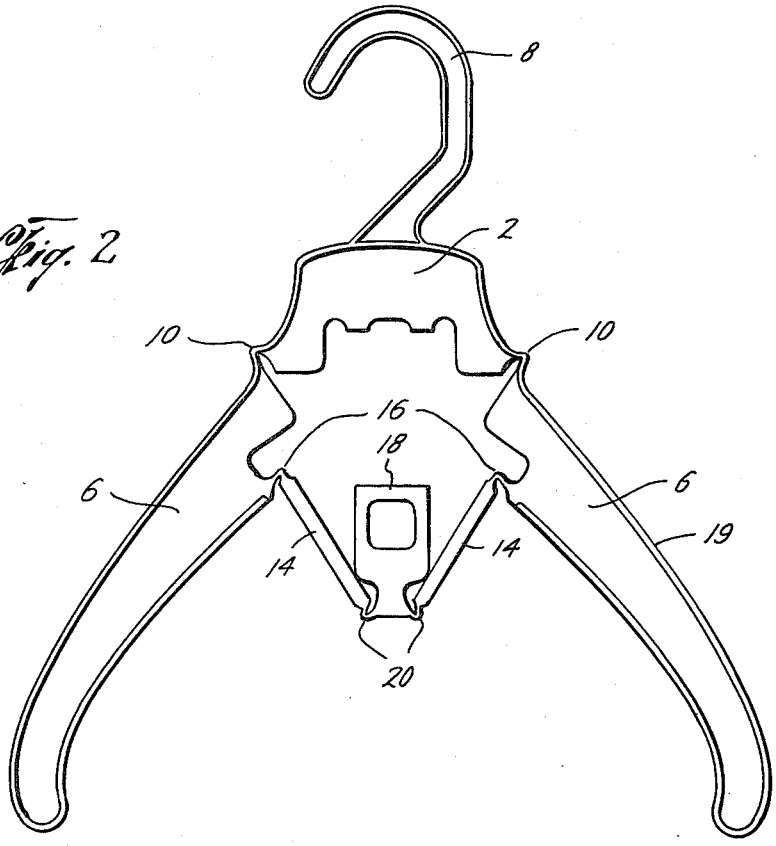
FIG. 2 is the side view of the invention showing the hanger in the unlocked and collapsed position.

One embodiment of the new hanger device as shown in FIGS. 1 and 2 has a hook member 8 molded with a body 2 having two sides 4 thereof. Two hanger arms 6 extend from the respective sides 4 of the body 2 and are each connected to the respective sides by means of an integral deformable hinge portion 10. The integral deformable hinge portions of the hanger are made of a low-density, plastic-like material such as, by way of example and not by limitation, polypropylene. The deformable integral hinge portions are sufficiently thin to permit the arms 6 to be deformed inwardly and downwardly into a collapsed position such that the hanger can be removed through the neck or other similar aperture of a garment hanging thereupon.

It is preferably to have a locking means to maintain the arms 6 in a deployed position as shown in FIG. 1. The locking means can take many forms; however, a preferred locking means utilizes a locking bar 14 having a stop member 18 projecting from the locking bar 14 in the direction of the body 2. The locking bar is connected at either end thereof to the corresponding hanger arms 6. An integral deformable hinge portion is disposed between each end of the locking bar and its corresponding hanger arm thereby securing the locking bar at each end thereof to the corresponding hanger arm 6. Another pair of integral deformable hinge portions 20 are located on the locking bar 14 such that one hinge portion is disposed on either side of the stop member 18. The integral deformable hinge portions 10, 16 and 20 can be substantially similar for ease of manufacture. Accordingly, downward pressure on the locking bar 14 or on the stop member 18 causes the hinges 16 and 20 to be deflected so that the stop member 18 and the locking bar 14 move downwardly thereby permitting the hanger to assume a collapsed position as shown in FIG. 2. When the hanger is in the deployed position as shown in FIG. 1, the locking bar is disposed in an overcentered locking position; that is, downward forces on the hanger arms 6 are translated along the locking bar 14 whereby the stop member 18 is forced upward into abutting contact with the body 2. The contact of the stop member 18 against the body 2 prevents the arms 6 from further movement in a downward or inward direction and substantially locks the hanger arms into the developed position. To force the hanger into the collapsed position as shown in FIG. 2, it is necessary to displace the stop member 18 or locking bar 14 downwardly past a centered position. A centered position occurs when the locking bar is substantially in a straight line. Once the locking bar is deformed downwardly past the centered position, forces exerted on the hanger arms 6 continue to deform the locking bar 14 in a downward direction into the collapsed position as shown in FIG. 2. Preferably, a molding 19 is incorporated onto the hanger to increase the hanging surface on the arms as well as to increase generally the stability and rigidity of the hanger as a whole. The molding 19 further permits an increased area of flexion at the point where the integral deformable hinge portions 10 are located. Accordingly, increased flexure life of the hinge portions 10 will occur.

Figure 7:
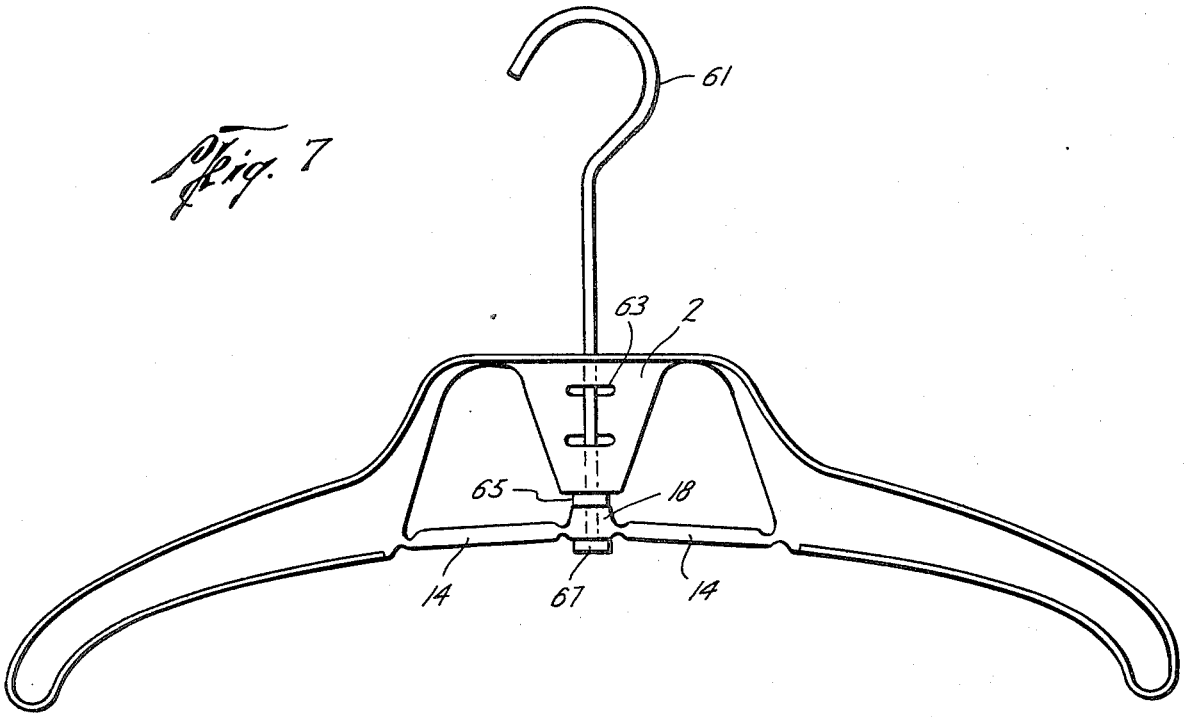
FIG. 7 shows a hanger having a locking device activated by movement of a hook member.
Figure 8:
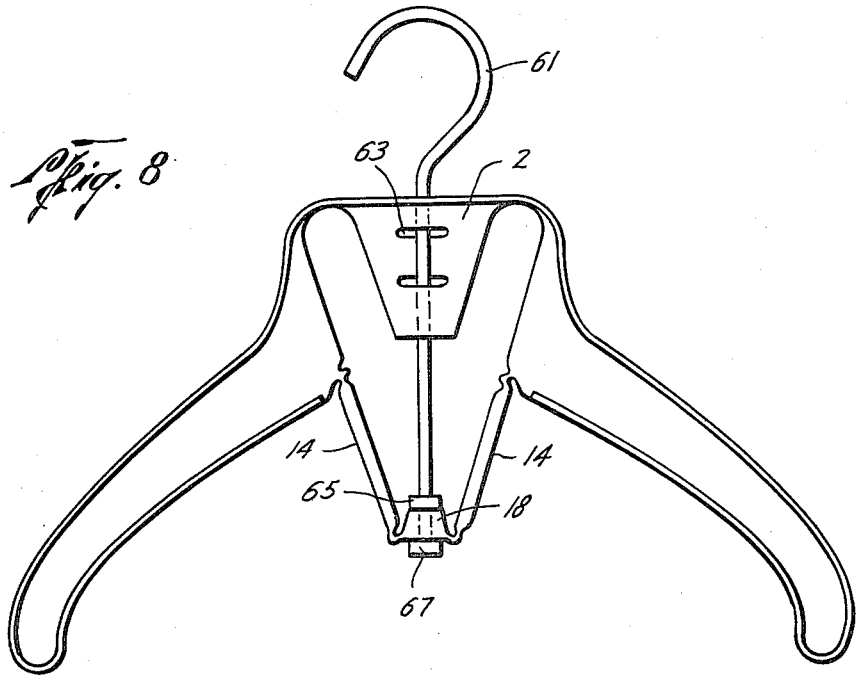
FIG. 8 shows the device in FIG. 7 in a collapsed position.

Another embodiment of the new flexible garment hanger as shown in FIG. 7 has a hook member 61 which is not integrally molded to the body 2 of the hanger. The hook member 61 is received by at least one aperture 63 in the body 2 of the hanger such that the hook member can slide within the aperture. The lower end of the hook member 61 is further secured to the stop member 18 so that an upward force on the hook member 61 brings the stop member 18 into abutting engagement with the body 2 while a downward force on the hook member forces the stop member 18 downwardly, bringing the locking bar 14 past the overcenter position thereby permitting the hanger to assume a collapsed position. By way of example and not limitation, an upper retainer 65 and a lower retainer 67 can be the means for securing the hook member 61 to the stop member 18.

Figure 3:
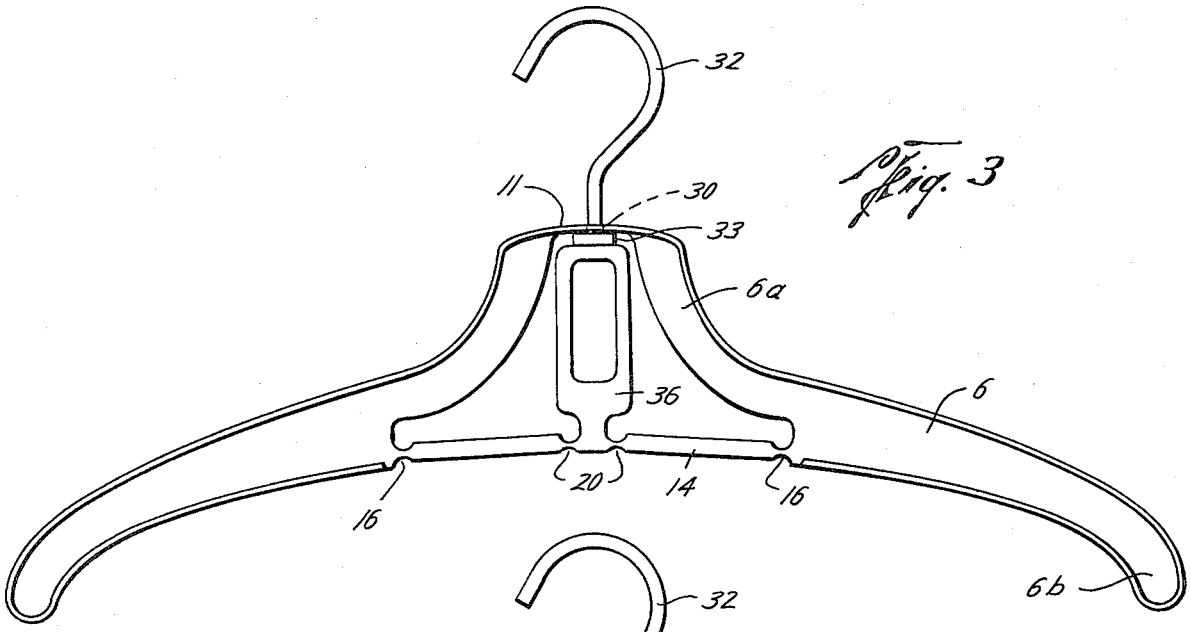
FIG. 3 is another embodiment of the hanger having one flexible hinge separating the hanger arms through which a metal hook member is secured.
Figure 4:
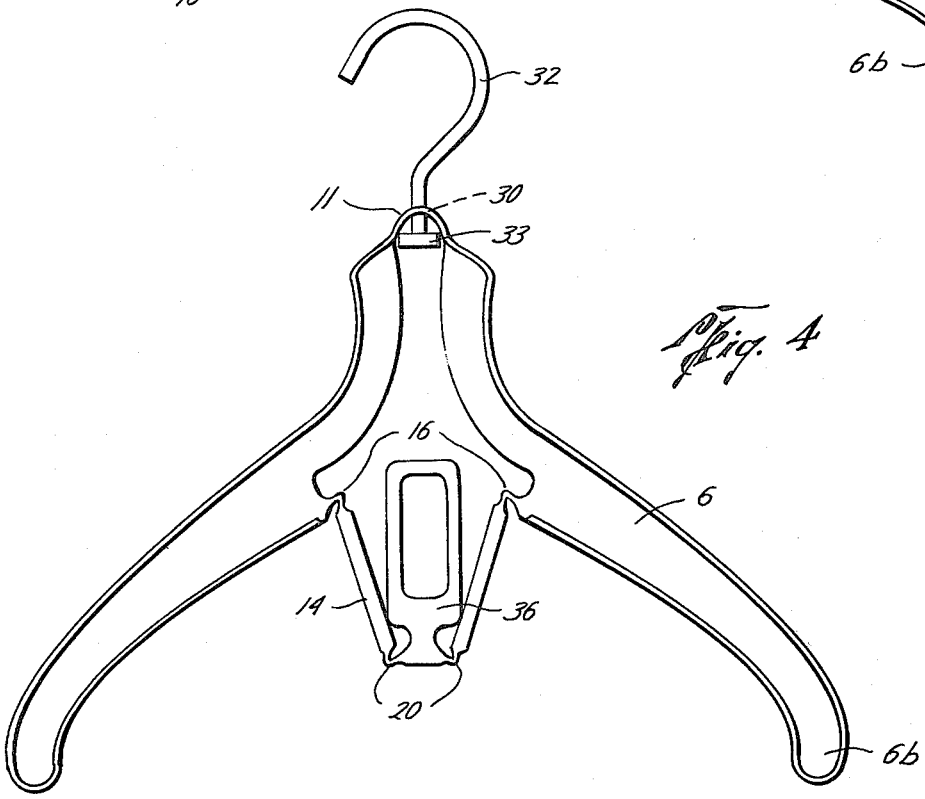
FIG. 4 is a view of the device in FIG. 3 as shown in the collapsed position.

Another embodiment of the new flexible garment hanger replaces the two hinge portions 10 of FIG. 1 with one integral deformable hinge portion 11 as shown in FIG. 3. Located within the hinge portion 11 is an aperture 30 through which a hook member 32 is received. A retainer 33 is secured to the hook member 32 such that the hook member cannot be removed upwardly through the aperture 30 in the hinge portion 11. As shown in FIG. 3, each hanger arm 6 is composed of a low-density plasticlike material and is connected to each other by means of an integral deformable hinge portion 11. The hanger arms 6 therefore are deflectable about the hinge portion 11. A locking device similar to that as shown in FIG. 1 locks the hanger arms 6 into a deployed position as shown in FIG. 3 or unlocks permitting the hanger to assume a collapsed position as shown in FIG. 4. Those skilled in the art will realize that the hook member 32 can be secured to the stop member 36 to permit locking and unlocking of the locking device by movement of the hook.

Figure 5:
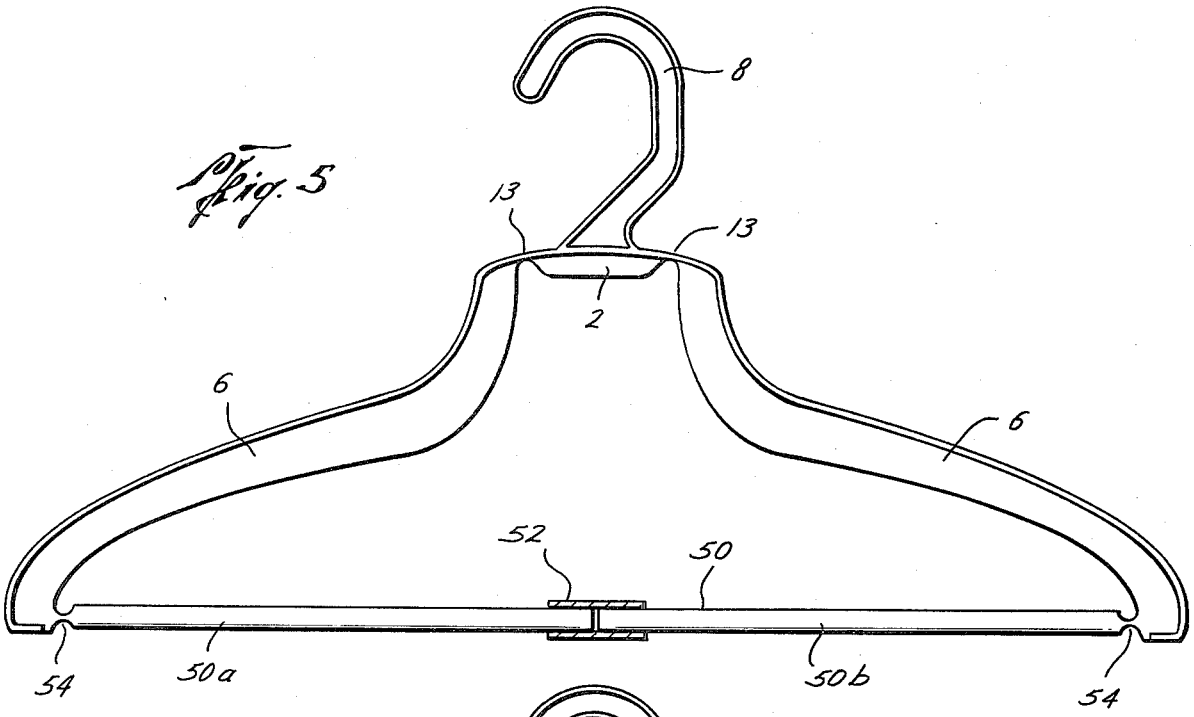
FIG. 5 shows a side view of another embodiment of the flexible hanger in the deployed position, the locking device being a trouser bar flexibly connected at each end to the respective hanger arms by means of a flexible hinge portion, and having a means thereon to rigidly lock the trouser bar in an extended position.
Figure 6:
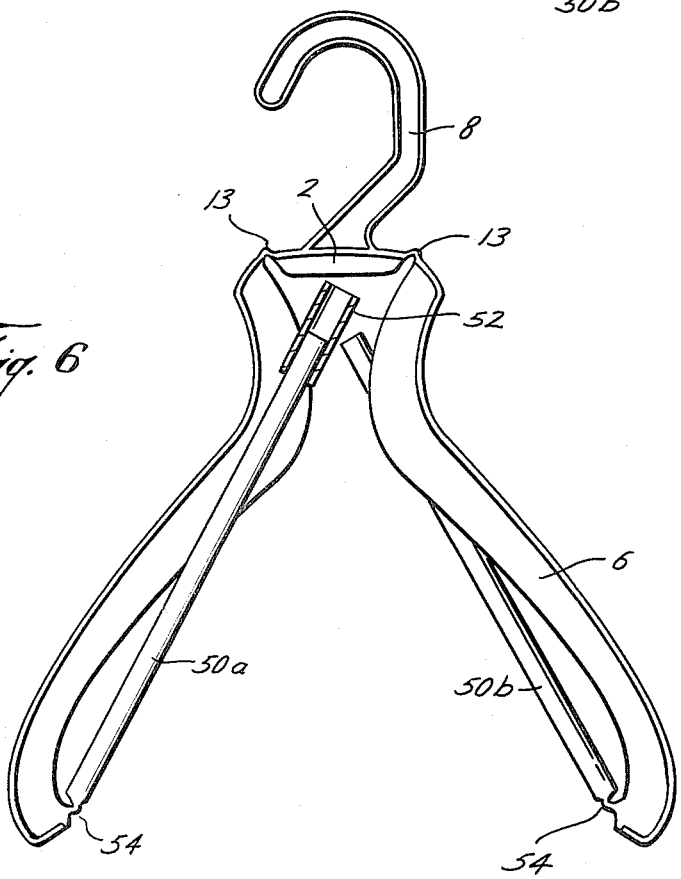
FIG. 6 shows a device of FIG. 5 in the unlocked and collapsed position.

An additional embodiment of the present invention is found in FIG. 5. A hook member 8 is integrally molded to a body 2. A pair of hanger arms 6 are connected to the body member 2 by means of a pair of integral flexible hinge portions 13 substantially similar to the hinge portions 10 in FIG. 1. Downward and inward forces on the hanger arms 6 therefore cause the hanger arms to deflect about the hinge portions 13. A two-segment trouser bar 50 comprising segments **50*a* and 50*b* not only supports a pair of trousers or other similar garment but also serves as a locking device with a hanger. Each segment 50*a* and 50*b* is connected at an outer end thereof to the respective hanger arms 6 by means of an integral deformable hinge portion 54. When the segments 50*a* and 50*b* are ridigly alligned such as, for example and not by way of limitation a rigid member 52, the hanger is locked into a deployed position as shown in FIG. 5. If one of the segments of the trouser bar 50 is removed from the rigid member 52, the trouser bar 50 is then separated into two segments 50*a* and 50*b* thereby unlocking a locking function of the trouser bar. When the trouser bar 50** is unlocked, the hanger arms may be deflected downwardly and inwardly as shown in FIG. 6 such that the hanger assumes a collapsed position.

Those skilled in the art and familiar with the manufacture of garment hangers will realize that the embodiments as shown in FIGS. 1, 2, 5 and 6 are preferably formed of a one-piece molding in a one-step operation. The deformation hinge portions are integrally formed in the one-step molding process. When the grain of the plastic-like material is properly alligned by the flow of the material into the mold, the various integral deformable hinge portions give increased flexion life. Those skilled in the art will further realize that the embodiments of the new device as shown in FIGS. 3, 4, 7, and 8 require a separate and non-integral hook member capable of sliding within the aperture 30. The various embodiments of the new invention, therefore, provide a new and useful garment hanger which can be economically manufactured and which meets the objectives of the invention as heretofore set forth. It is understood that numerous other embodiments, combinations and rearrangements of combinations fall both within the spirit and the scope of the present invention as claimed, described in the specification and illustrated in the figures appended hereto.

What is claimed is

1. A flexible garment hanger including a body having two sides, a hanger arm projecting from either side of body such that both hanger arms and the body are substantially within a single plane and a hook member connected to said body further comprising, (a) means for flexibly connecting one end of each hanger arm to its corresponding body side such that both hanger arms can be extended into a deployed position and deflected downwardly into a collapsed position;

(b) an elongated locking bar having two ends, each end thereof flexibly secured to the corresponding hanger arm;

(c) overcenter stop means flexibly secured to the locking bar, and;

(d) a means to urge the stop member against the body.

2. The apparatus of claim 1 wherein the body and the hanger arms compromise a one-piece molded unit.

3. The device of claim 2 wherein the means (a) is an integral, deformable hinge portion connecting one end of each hanger arm to the corresponding side of the body.

4. The apparatus of claim 1 wherein the body, the arms and the overcenter stop means (b) are a one-piece molded unit.

5. The apparatus of claim 1 wherein the body, the hanger arms, the overcenter stop means (b) and the hook are a one-piece molded unit.

6. The apparatus of claim 1 wherein the overcenter stop means includes (a) a locking bar having two ends, each end thereof connected to each hanger arm by an integral, deformable hinge portion, (b) a stop member projecting upwardly from the median of the locking bar, (c) an integral deformable hinge portion disposed on either side of the stop member such that the stop member can be urged upwardly into abutting contact with the body and urged downwardly sufficiently to permit the hanger arms to be collapsed downwardly , and (d) means to urge the stop member upwardly and downwardly.

7. The apparatus of claim 6 wherein the means (d) is a hook member having a straight segment and a curved segment, said straight segment extending through and slideably received by the body and stop member, said straight segment having a retainer at an end thereof whereby upward movement of the hook member urges the retainer against the stop member until said stop member abuts the body and the locking bar is flexed overcenter toward the body.

8. The device of claim 1 wherein the means (d) is the downward urging of the hanger arms.

9. A flexible, plastic-like garment hanger comprising:

(a) two arm members each having two ends, (b) means for flexibly connecting one end of the first arm to an end of the second arm such that the unaffixed ends of the arms can be forced toward one another to collapse said hanger or can be extended into a deployed position, (c) an overcenter stop means to lock said arms in the deployed position, (d) an aperture through said flexible connecting means (b), and (e) a hook member having a curved segment and a straight segment, said straight extending through said aperture (d), said straight portion additionally having a retainer to prevent removal of the hook from said aperture and said hook member positioned such that the curved segment projects above the hanger to permit the curved section to engage a suitable hanger support.

10. The apparatus of claim 9 wherein the means (b) is an integral, deformable plastic-like hinge connecting the hanger arms.

11. A flexible garment hanger including a body having two sides, a hanger arm projecting from either side of said body such that both hanger arms and the body are substantially within a single plane and a hook member connected to said body further compromising:

(a) means for flexibly connecting one end of each hanger arm to its corresponding body side such that both hanger arms can be extended into a deployed position or deflected downwardly into a collapsed position;

(b) an overcenter lock means to maintain the hanger arms in the deployed position such that the weight of the garment on the arms of said hanger will not collapse said hanger arms, said overcenter lock means including, (i) a locking bar extending between and connecting the two hanger arms, having integral deformable hinge portions at each end thereof which connect the locking bar to each hanger arm, said locking bar disposed below the body of the flexible garment hanger, (ii) a stop member projecting upwardly from the median of the locking bar toward the body, and (c) an integral deformable hinge portion of the locking bar disposed adjacent to and on either side of said stop member such that as the stop member is urged toward the body, the locking bar becomes overcentered and the stop member abuts the body, and when the stop member is displaced downwardly away from the body beyond an overcenter position of the locking bar, the hanger arms are deflected downwardly and inwardly into a collapsed position.

12. The apparatus of claim 11 wherein the stop member and the body carry a means to secure said stop member mechanically to the body when the body and the stop member are urged into abutting contact.

13. The apparatus of claim 12 wherein the hanger arms, the hook member, the body and the overcenter lock means are formed of a low density, plastic-like material sufficient to afford a reasonable useful life of the integral deformable hinge portions.

* * * * *

UNITED STATES PATENT OFFICE

CERTIFICATE OF CORRECTION

Patent No. 4,227,632 Dated October 14, 1980

Inventor(s) John H. Collis

It is certified that error appears in the above-identified patent and that said Letters Patent are hereby corrected as shown below:

In Column 1, line 7, cancel "to" and insert --the--.
In Column 1, line 8, cancel "ceptable" and insert --ceptably--.
In Column 3, line 62, cancel "developed" and insert --deployed--.
In Column 4, line 62, cancel "ridigly" and insert -- rigidly --.
In Column 5, line 8, cancel "deformation" and insert --deformable--.

In the Claims:

In Claim 6, column 5, line 68, between "downwardly" and "," insert --and inwardly--.

Signed and Sealed this

*Twenty-fourth* Day of *March 1981*

[SEAL]

*Attest:*

RENE D. TEGTMEYER

*Attesting Officer* *Acting Commissioner of Patents and Trademarks*